US011598046B2

(12) United States Patent
Yan et al.

(10) Patent No.: US 11,598,046 B2
(45) Date of Patent: Mar. 7, 2023

(54) CLOTHING SHAKING DEVICE FOR CLOTHING CARE APPARATUS

(71) Applicants: QINGDAO HAIER WASHING MACHINE CO., LTD., Shandong (CN); Haier Smart Home Co., Ltd., Shandong (CN)

(72) Inventors: Fenggang Yan, Qingdao (CN); Xiumei Wang, Qingdao (CN); Li Ma, Qingdao (CN); Zongjiang Qin, Qingdao (CN)

(73) Assignees: QINGDAO HAIER WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 0 days.

(21) Appl. No.: 17/623,139

(22) PCT Filed: Jun. 30, 2020

(86) PCT No.: PCT/CN2020/099232
§ 371 (c)(1),
(2) Date: Dec. 27, 2021

(87) PCT Pub. No.: WO2021/000854
PCT Pub. Date: Jan. 7, 2021

(65) Prior Publication Data

US 2022/0267946 A1 Aug. 25, 2022

(30) Foreign Application Priority Data

Jul. 2, 2019 (CN) ..... 201910590580.7

(51) Int. Cl.
*D06F 87/00* (2006.01)

(52) U.S. Cl.
CPC ..... *D06F 87/00* (2013.01)

(58) Field of Classification Search
CPC ..... D06F 87/00; D06F 73/00; D06F 73/02
See application file for complete search history.

(56) References Cited

U.S. PATENT DOCUMENTS 8,484,868 B2 * 7/2013 Kim ..... D06F 58/12 211/124
2003/0223309 A1 * 12/2003 Hapke ..... D06F 73/02 366/342

(Continued)

FOREIGN PATENT DOCUMENTS

CN 103510357 A 1/2014
CN 107460702 A 12/2017

(Continued)

OTHER PUBLICATIONS

International Search Report dated Oct. 12, 2020 in corresponding International application No. PCT/CN2020/099232; 7 pages (with English Translation).

*Primary Examiner* — Ismael Izaguirre
(74) *Attorney, Agent, or Firm* — Maier & Maier, PLLC

(57) ABSTRACT

Provided is a clothing shaking device for clothing care apparatus, the care apparatus includes a cabinet, the shaking device includes a driving member, a first connecting member, a second connecting member, a beam and a connecting structure arranged on the beam, when the driving member drives the first connecting member to rotate and thus drives the second connecting member to move, a swimming structure can apply acting force to the connecting structure to make the connecting structure and the beam move back and forth together. Through the connection between the swimming structure and the connecting structure, when the driving member drives the first connecting member to rotate and thus drives the second connecting member to move, while (Continued)

driving the beam to move back and forth, the movement amplitude of the beam in the direction perpendicular to the beam can be reduced.

10 Claims, 6 Drawing Sheets

(56) References Cited

U.S. PATENT DOCUMENTS

| | | | | |
|---|---|---|---|---|
| 2010/0043500 | A1* | 2/2010 | Yoo | D06F 73/02 68/5 C |
| 2011/0296703 | A1* | 12/2011 | Kim | D06F 73/02 34/218 |

FOREIGN PATENT DOCUMENTS

| | | | |
|---|---|---|---|
| CN | 208440858 | U | 1/2019 |
| CN | 109930348 | A | 6/2019 |
| CN | 209039809 | U | 6/2019 |
| CN | 211112833 | U | 7/2020 |
| KR | 20100022798 | A | 3/2010 |

* cited by examiner

CLOTHING SHAKING DEVICE FOR CLOTHING CARE APPARATUS

FIELD

The present disclosure belongs to the technical field of clothing care, and specifically provides a clothing shaking device for a clothing care apparatus.

BACKGROUND

When the clothing is being washed in a washing machine, the clothing continuously rolls, rotates and entangles with each other in the washing machine, and the clothing will often have some wrinkles after the washing is completed.

In the prior art, wrinkles on the clothing can be removed by a clothing care machine. Specifically, a clothing shaking device is provided in a cabinet of the clothing care machine. The clothing shaking device includes a driving motor, a transmission mechanism and a cross beam; the driving motor is pivotally connected to the cross beam through the transmission mechanism, and can drive the cross beam to move back and forth; and the clothing with wrinkles is hung on the cross beam by a hanger. When the cross beam moves back and forth, the clothing can be driven to shake to achieve the purpose of removing wrinkles. However, when the driving motor drives the cross beam to move back and forth, due to a large movement amplitude of the cross beam in a direction perpendicular to the cross beam, the hanger will constantly impinge on an inner wall of the cabinet, thereby producing louder noise and affecting the user's experience in use.

Accordingly, there is a need in the art for a new clothing shaking device for a clothing care apparatus to solve the above problem.

SUMMARY

In order to solve the above problem in the prior art, that is, to solve the problem that the hanger hung on the cross beam will constantly impinge on the inner wall of the cabinet of the clothing care apparatus when the existing clothing shaking device is running, which produces louder noise, the present disclosure provides a clothing shaking device for a clothing care apparatus, in which the clothing care apparatus includes a cabinet, and the clothing shaking device includes a driving member, a first connection member, a second connection member, a cross beam, and a connection structure provided on the cross beam; in which the driving member is fixedly connected to the cabinet, the cross beam is movably connected to the cabinet, the driving member is connected to a first end of the first connection member, and a second end of the first connection member is pivotally connected to a first end of the second connection member; a second end of the second connection member is provided with a wandering structure, and the wandering structure is drivingly connected to the connection structure; when the driving member drives the first connection member to rotate and thus drives the second connection member to move, the wandering structure can apply a force to the connection structure, which enables the connection structure and the cross beam to move back and forth together, and the wandering structure can weaken a movement transmitted to the cross beam via the second connection member in a direction perpendicular to the cross beam.

In a preferred technical solution of the above clothing shaking device, the wandering structure is a slip ring, and at least a part of the connection structure is accommodated in the slip ring; when the driving member drives the first connection member to rotate and thus drives the second connection member to move, the slip ring can apply a force to the connection structure, which enables the connection structure and the cross beam to move back and forth together, and the slip ring allows the connection structure to slide in the slip ring in the direction perpendicular to the cross beam.

In a preferred technical solution of the above clothing shaking device, a first spacing between inner side walls of the slip ring is larger than a maximum length of the connection structure, and a second spacing between the inner side walls of the slip ring is larger than or equal to the maximum length of the connection structure; in which the first spacing is a spacing of the inner side walls of the slip ring in the direction perpendicular to the cross beam, and the second spacing is a spacing of the inner side walls of the slip ring in a direction parallel with the cross beam.

In a preferred technical solution of the above clothing shaking device, the inner side walls of the slip ring jointly enclose an oblong-hole structure.

In a preferred technical solution of the above clothing shaking device, the inner side walls of the slip ring jointly enclose a rectangular-hole structure.

In a preferred technical solution of the above clothing shaking device, the connection structure includes a swing rod and a connection column provided on the swing rod, the swing rod being connected to the cross beam, and the connection column being accommodated in the slip ring.

In a preferred technical solution of the above clothing shaking device, a first fixed structure and a second fixed structure are provided on the cross beam, and two ends of the swing rod are connected to the first fixed structure and the second fixed structure respectively.

In a preferred technical solution of the above clothing shaking device, the clothing shaking device further includes a protective box, which is fixedly connected to the cabinet; the first connection member, the second connection member, the swing rod and the connection column are all arranged in the protective box, the protective box is provided with a through hole on a side facing the cross beam, and both the first fixed structure and the second fixed structure pass through the through hole to be connected to the swing rod.

In a preferred technical solution of the above clothing shaking device, the through hole includes a first through hole and a second through hole, in which the first fixed structure passes through the first through hole to be connected to one end of the swing rod, and the second fixed structure passes through the second through hole to be connected to the other end of the swing rod.

In a preferred technical solution of the above clothing shaking device, the driving member is a motor, and/or the first connection member is a first connecting rod, and the second connection member is a second connecting rod.

It can be understood by skilled in the art that in the preferred technical solutions of the present disclosure, a wandering structure is provided at the second end of the second connection member, and the wandering structure is drivingly connected to the connection structure provided on the cross beam, so that when the driving member drives the first connection member to rotate and thus drives the second connection member to move, the wandering structure drives the cross beam to move back and forth, and at the same time, a movement transmitted to the cross beam by the second connection member in the direction perpendicular to the cross beam can also be weakened, which can reduce a movement amplitude of the cross beam in the direction perpendicular to the cross beam, so as to prevent the hanger installed on the cross beam from impinging on the inner wall of the cabinet, thereby avoiding noise generation and improving the user's experience in use.

Further, a first fixed structure and a second fixed structure are provided on the cross beam, and two ends of the swing rod are respectively connected to the first fixed structure and the second fixed structure. Through such an arrangement, force bearing points of the cross beam are increased, so that damage to the cross beam caused by stress concentration can be avoided, and the service life of the cross beam can be prolonged.

Still further, the clothing shaking device further includes a protective box, which is fixedly connected to the cabinet, and the first connection member, the second connection member, the swing rod and the connection column are all arranged in the protective box. Through such an arrangement, the aesthetics of the clothing shaking device can be improved, and the first connection member, the second connection member, the swing rod, and the connection column are protected from impurities such as foreign dust, so that transmission between the first connection member, the second connection member, the swing rod and the connection column is not affected, thereby improving the reliability of the clothing shaking device; in addition, the protective box is fixedly connected to the cabinet instead of being fixedly connected to the cross beam, so that when the clothing shaking device is running, the driving member only needs to drive the cross beam to move back and forth with no need to also drive the protective box to move back and forth together, thereby reducing the load on the driving member and improving the shaking efficiency.

BRIEF DESCRIPTION OF DRAWINGS

Hereinafter, preferred embodiments of the present disclosure will be described with reference to the accompanying drawings. In the drawings.

DETAILED DESCRIPTION

Figure 1:
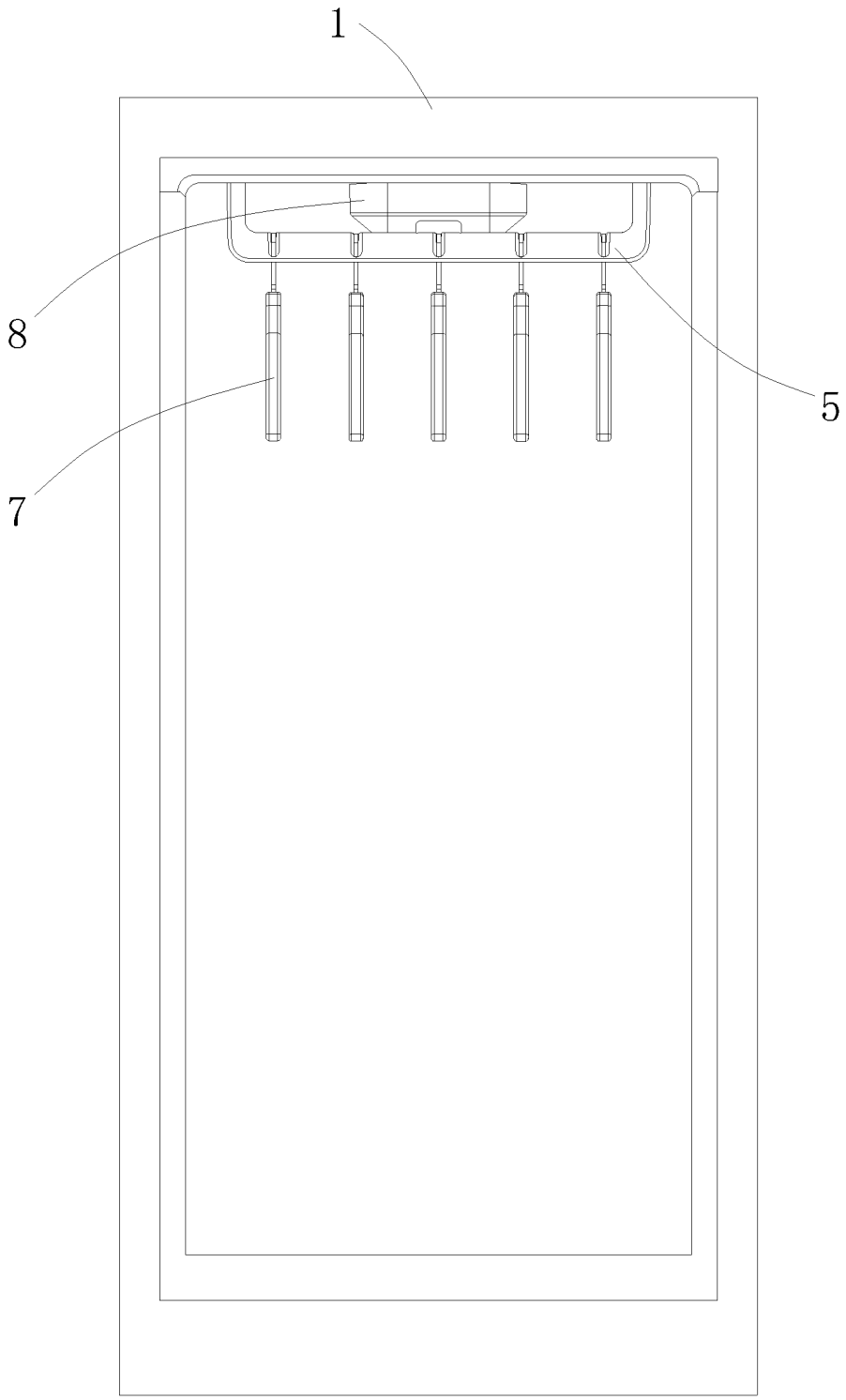
FIG. 1 is a schematic structural view of a clothing care apparatus.

Preferred embodiments of the present disclosure will described below with reference to the accompanying drawings. It should be understood by those skilled in the art that these embodiments are only used to explain the technical principles of the present disclosure, and are not intended to limit the scope of protection of the present disclosure. For example, although the various components in the drawings are drawn according to a certain proportional relationship, this proportional relationship is not invariable. Those skilled in the art can adjust it as needed so as to adapt to specific applications. The technical solutions after the adjustment will still fall within the scope of protection of the present disclosure.

It should be noted that in the description of the present disclosure, terms indicating directional or positional relationships, such as "upper", "lower", "left", "right", "inner", "outer" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure. In addition, terms "first" and "second" are only used for descriptive purposes, and should not be interpreted as indicating or implying relative importance.

In addition, it should also be noted that in the description of the present disclosure, unless otherwise clearly specified and defined, terms "arrange", "install", "connect" and "connection" should be understood in a broad sense; for example, the connection may be a fixed connection, or may also be a detachable connection, or an integral connection; it may be a direct connection, or an indirect connection implemented through an intermediate medium, or it may be internal communication between two elements. For those skilled in the art, the specific meaning of the above terms in the present disclosure can be interpreted according to specific situations.

Based on the problem pointed out in the "BACKGROUND" that the hanger hung on the cross beam will constantly impinge on the inner wall of the cabinet of the clothing care apparatus when the existing clothing shaking device is running, which produces louder noise, the present disclosure provides a clothing shaking device for a clothing care apparatus, aiming at reducing the movement amplitude of the cross beam in the direction perpendicular to the cross beam, so as to prevent the hanger installed on the cross beam from impinging on the inner wall of the cabinet, thereby avoiding noise generation and improving the user's experience in use.

Figure 2:
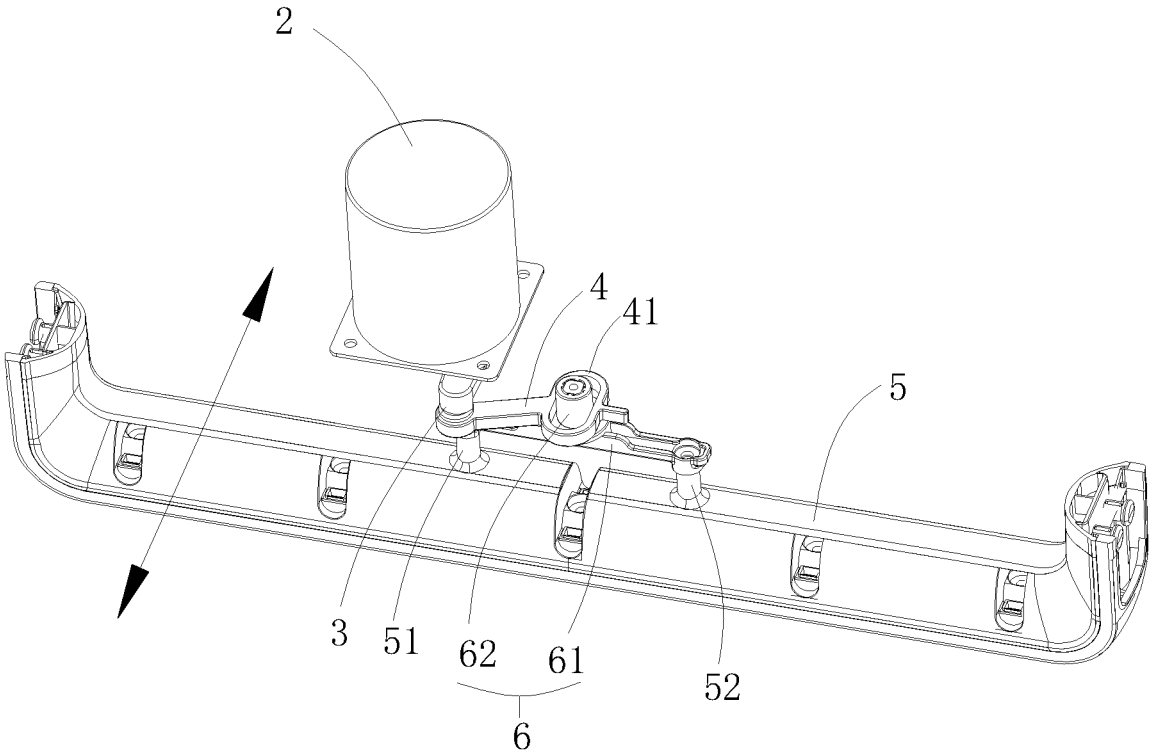
FIG. 2 is a schematic structural view of a clothing shaking device of the present disclosure.

Specifically, as shown in FIGS. 1 and 2, the clothing care apparatus includes a cabinet 1, and the clothing shaking device includes a driving member 2, a first connection member 3, a second connection member 4, a cross beam 5, and a connection structure 6 provided on the cross beam 5. The driving member 2 is fixedly connected with the cabinet 1, and the cross beam 5 is movably connected with the cabinet 1. The driving member 2 is connected with a first end of the first connection member 3, and a second end of the first connection member 3 is pivotally connected with a first end of the second connection member 4. A second end of the second connection member 4 is provided with a wandering structure 41, which is drivingly connected with the connection structure 6. When the driving member 2 drives the first connection member 3 to rotate and thus drives the second connection member 4 to move, the wandering structure 41 can apply a force to the connection structure 6, which enables the connection structure 6 and the cross beam 5 to move back and forth together, and the wandering structure 41 can weaken a movement transmitted to the cross beam 5 via the second connection member 4 in a direction perpendicular to the cross beam 5. It can be known from the "BACKGROUND" that when the existing clothing shaking device is running, the movement amplitude of the cross beam 5 in the direction perpendicular to the cross beam 5 (a direction indicated by the arrow in FIG. 2) is large, which causes the hanger 7 to constantly impinge on an inner wall of the cabinet 1. In the present disclosure, a wandering structure 41 is provided on the second connection member 4, and the wandering structure 41 is connected to the connection structure 6 provided on the cross beam 5. At the same time when the wandering structure 41 drives the cross beam 5 to move back and forth, the movement transmitted to the cross beam 5 via the second connection member 4 in the direction perpendicular to the cross beam 5 (the direction indicated by the arrow in FIG. 2) can also be weakened, thereby reducing the movement amplitude of the cross beam 5 in the direction perpendicular to the cross beam 5 (the direction indicated by the arrow in FIG. 2), and preventing the hanger 7 installed on the cross beam 5 from impinging on the inner wall of the cabinet 1. The driving member 2 is a motor 2, the first connection member 3 is a first connecting rod 3, and the second connection member 4 is a second connecting rod 4. Of course, the driving member 2 may also be provided as a hydraulic motor or a pneumatic motor, etc. Such adjustments and changes to the specific type of the driving member 2 do not depart from the principle and scope of the present disclosure, and should be defined within the scope of protection of the present disclosure. In addition, the first connection member 3 may also be provided as a circular disc, and the second connection member 4 is provided as a connecting rod. A first end of the circular disc is fixedly connected with an output shaft of the motor 2, a second end of the circular disc is pivotally connected with the connecting rod, and a connection line between the first end and the second end of the circular disc passes through a center of the circular disk. Alternatively, the first connection member 3 may also be provided as a square plate, and the second connection member 4 is provided as a connecting plate, in which a first end of the square plate is fixedly connected with the output shaft of the motor 2, a second end of the square plate is pivotally connected with the connecting plate, and a connection line between the first end and the second end of the square plate passes through a center of the square plate, etc. Such adjustments to the specific structural forms of the first connection member 3 and the second connection member 4 also do not depart from the principle and scope of the present disclosure.

Preferably, as shown in FIG. 2, the wandering structure 41 is a slip ring 41, and at least a part of the connection structure 6 is accommodated in the slip ring 41. When the driving member 2 drives the first connection member 3 to rotate and thus drives the second connection member 4 to move, the slip ring 41 can apply a force to the connection structure 6, which enables the connection structure 6 and the cross beam 5 to move back and forth together, and the slip ring 41 allows the connection structure 6 to slide in the slip ring 41 in the direction perpendicular to the cross beam 5. When the clothing shaking device is running, the connection structure 6 can slide in the slip ring 41 in the direction perpendicular to the cross beam 5 (the direction indicated by the arrow in FIG. 2), thereby reducing the movement amplitude of the cross beam 5 in the direction perpendicular to the cross beam 5 (the direction indicated by the arrow in FIG. 2), and preventing the hanger 7 installed on the cross beam 5 from impinging on the inner wall of the cabinet 1. The inner side walls of the slip ring 41 jointly enclose an oblong-hole structure (just as shown in the figure). Of course, the inner side walls of the slip ring 41 may also jointly enclose a structure of other shapes, such as a rectangular-hole structure. Such adjustments and changes to the specific shape of the structure of the slip ring 41 do not depart from the principle and scope of the present disclosure, and should be defined within the scope of protection of the present disclosure. Of course, the wandering structure 41 is not limited to the above structure of slip ring. For example, the wandering structure 41 may also be provided as a plate-shaped structure, and an elastic member is provided on the plate-shaped structure so that the elastic member is drivingly connected to the connection structure 6. When the clothing shaking device is running, the elastic member can be elastically deformed to weaken the movement transmitted to the cross beam via the second connection member in the direction perpendicular to the cross beam, etc. Such adjustments and changes to the specific structural form of the wandering structure 41 do not depart from the principle and scope of the present disclosure, and should be defined within the scope of protection of the present disclosure.

Figure 3:
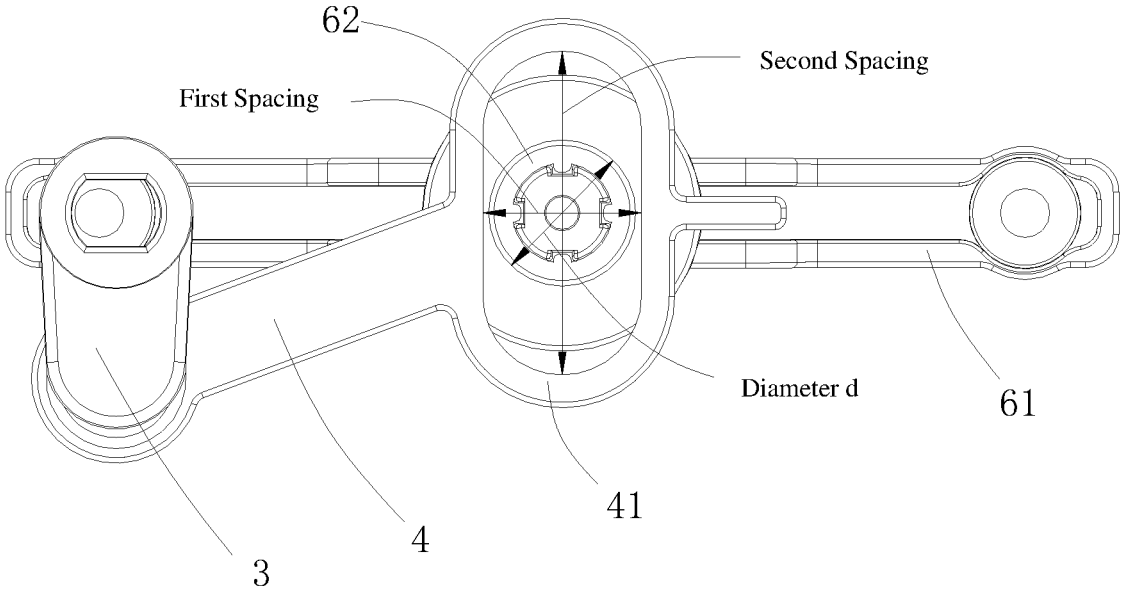
FIG. 3 is a schematic view of the connection of a first connection member, a second connection member and a connection structure of the present disclosure.

Preferably, as shown in FIGS. 2 and 3, a first spacing between the inner side walls of the slip ring 41 is larger than a maximum length of the connection structure 6, and a second spacing between the inner side walls of the slip ring 41 is larger than or equal to the maximum length of the connection structure 6. The first spacing is a spacing of the inner side walls of the slip ring 41 in the direction perpendicular to the cross beam 5, and the second spacing is a spacing of the inner side walls of the slip ring 41 in a direction parallel to the cross beam 5. It should be noted that the maximum length of the connection structure 6 refers to a maximum length of a part of the connection structure 6 that is accommodated in the slip ring 41. Specifically, the connection structure 6 of the present disclosure includes a swing rod 61 and a connection column 62 provided on the swing rod 61. The swing rod 61 is connected to the cross beam 5, and the connection column 62 is accommodated in the slip ring 41. The maximum length of the connection structure 6 is the maximum length of the connection column 62, i.e., a diameter d of the connection column 62. The first spacing is larger than the diameter d, so that the connection column 62 can slide in the direction perpendicular to the cross beam 5. The second spacing is preferably slightly larger than the diameter d, so as to prevent a relatively large friction from being generated between the connection column 62 and the inner sides wall of the slip ring 41, which would hinder the connection column 62 in sliding in the slip ring 41. Of course, the second spacing may also be made equal to the diameter d, and then a lubricant is added between the connection column 62 and the inner wall of the slip ring 41 to reduce the friction between the connection column 62 and the inner wall of the slip ring 41. In addition, the connection structure 6 may also be configured into other structural forms; for example, the swing rod 61 is omitted, the connection structure 6 is configured as a connection column 62, and a bottom of the connection column 62 is connected to the cross beam 5; alternatively, a columnar protrusion is directly formed on the cross beam 5, and a top of the columnar protrusion is accommodated in the slip ring 41, etc. Such adjustments and changes to the specific structural form of the connection structure 6 do not depart from the principle and scope of the present disclosure, and should be defined within the scope of protection of the present disclosure.

Preferably, as shown in FIG. 2, the cross beam 5 is provided with a first fixed structure 51 and a second fixed structure 52, and two ends of the swing rod 61 are connected to the first fixed structure 51 and the second fixed structure 52, respectively. The first fixed structure 51 is a first fixed column 51, which is fixedly connected to or integrated with the cross beam 5, and the second fixed structure 52 is a second fixed column 52, which is fixedly connected to or integrated with the cross beam 5. A left end of the swing rod 61 is fixedly connected with the first fixed column 51, and a right end of the swing rod 61 is fixedly connected with the second fixed column 52. Of course, the first fixed structure 51 may also be provided as a fixed boss or a fixed seat, etc. Similarly, the second fixed structure 52 may also be provided as a fixed boss or a fixed seat, etc. Such adjustments and changes to the specific structural forms of the first fixed structure 51 and the second fixed structure 52 do not depart from the principle and scope of the present disclosure, and should be defined within the scope of protection of the present disclosure.

Figure 4:
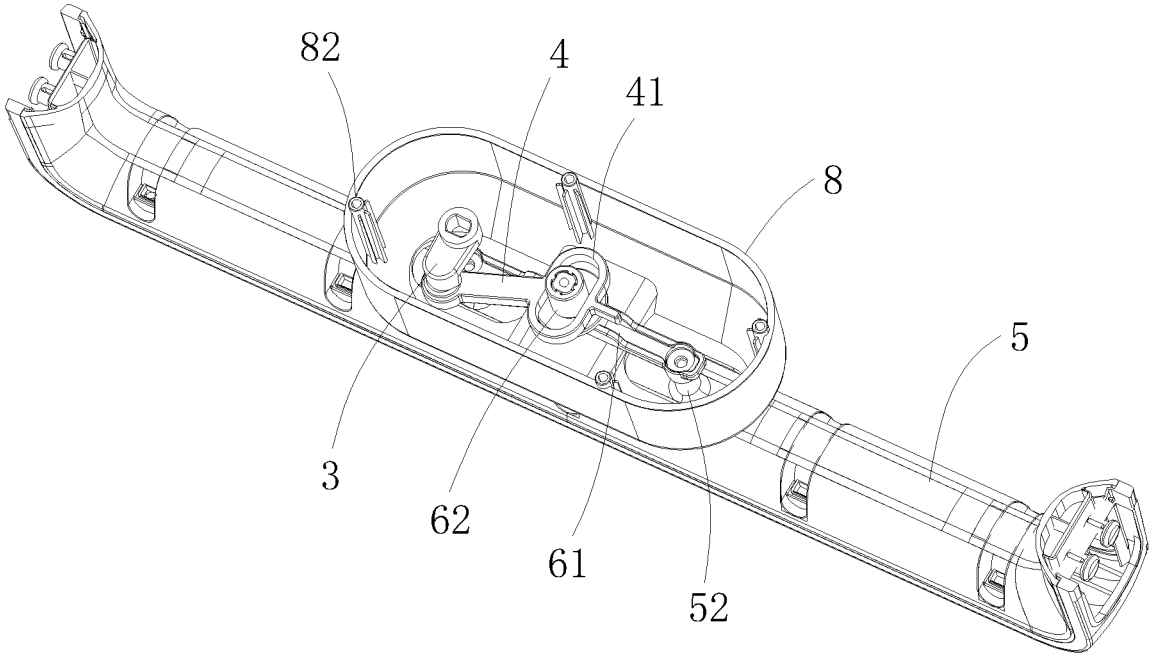
FIG. 4 is a schematic view of the connection of a cross beam, a protective box, the first connection member, the second connection member and the connection structure of the present disclosure.
Figure 5:
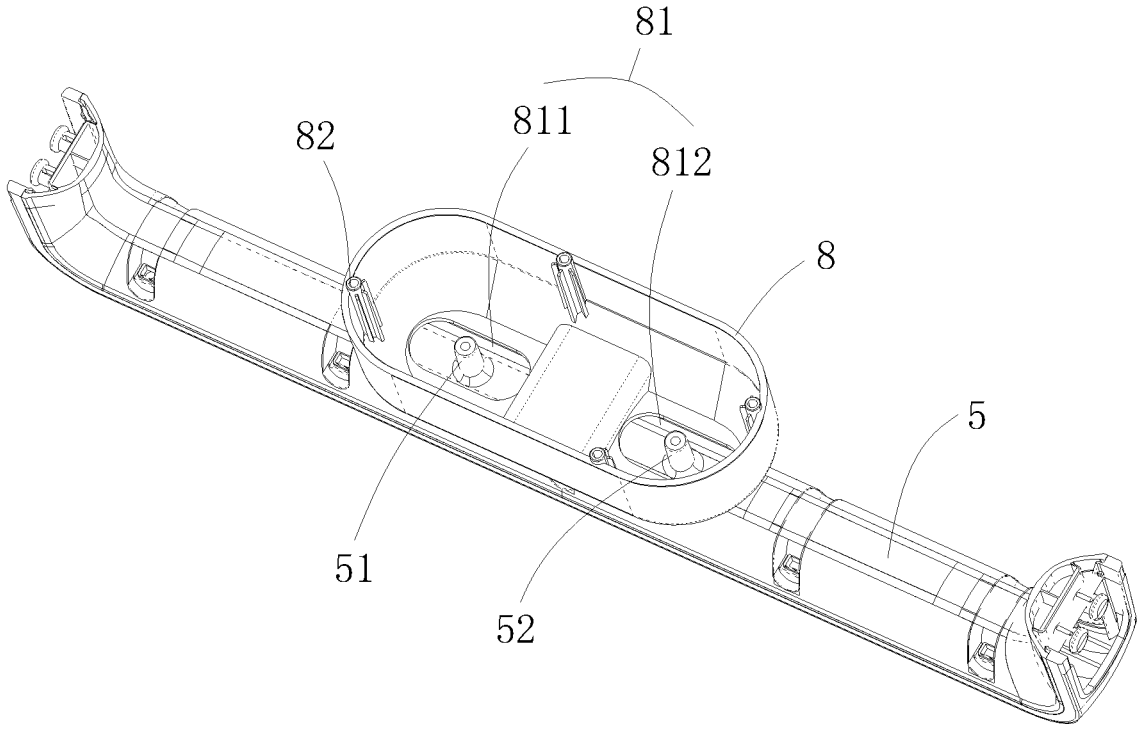
FIG. 5 is a schematic structural view of the cross beam and the protective box of the present disclosure.
Figure 6:
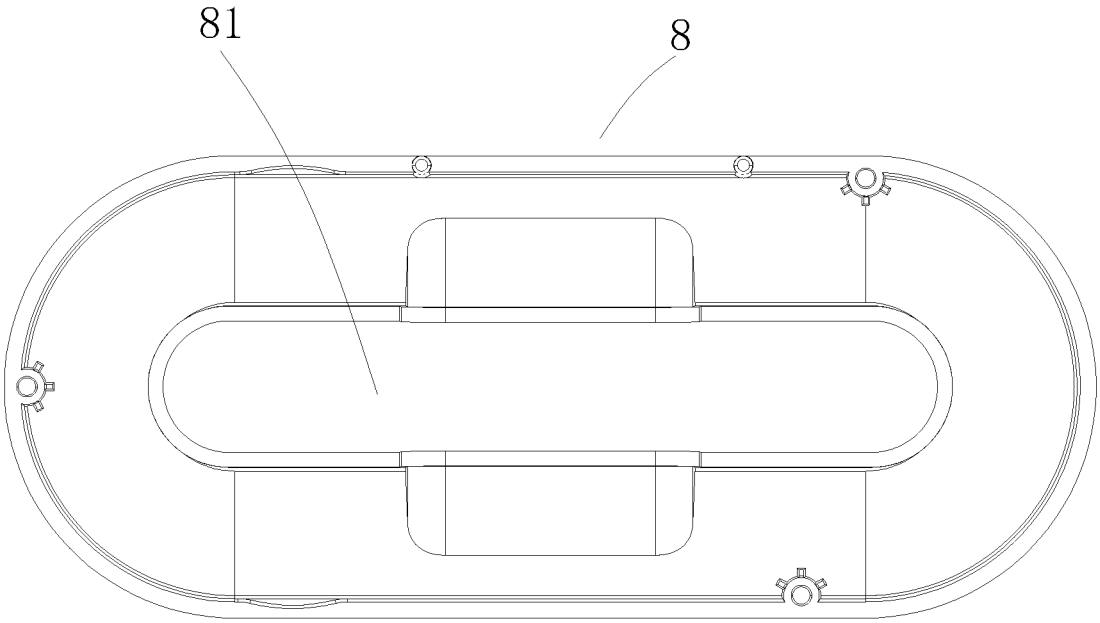
FIG. 6 is a schematic structural view of an embodiment of the protective box of the present disclosure.

Preferably, as shown in FIGS. 1, 4, 5 and 6, the clothing shaking device further includes a protective box 8. The protective box 8 is fixedly connected to the cabinet 1, and the first connection member 3, the second connection member 4, the swing rod 61 and the connection column 62 are all arranged in the protective box 8. The protective box 8 is provided with a through hole 81 on a side facing the cross beam 5, and the first fixed structure 51 and the second fixed structure 52 both pass through the through hole 81 to be connected to the swing rod 61. It should be noted that when the clothing shaking device is running, the first fixed structure 51 and the second fixed structure 52 can move freely in the through hole 81; that is, the through hole 81 does not restrict the movement of the cross beam 5. The through hole 81 includes a first through hole 811 and a second through hole 812. The first fixed structure 51 passes through the first through hole 811 to be connected to one end of the swing rod 61, and the second fixed structure 52 passes through the second through hole 812 to be connected to the other end of the swing rod 61. Of course, the first through hole 811 and the second through hole 812 may also communicate with each other to form one through hole 81 (just as shown in FIG. 6).

In addition, it should be noted that in order to facilitate installing the protective box 8 on the cabinet 1, the clothing shaking device further includes a positioning structure, and the protective box 8 is positioned on the cabinet 1 through the positioning structure. The positioning structure may be provided as a structure in which a positioning column matches with a positioning hole, or as a structure in which a positioning plate matches with a positioning slot, or as a structure in which a positioning block matches with a positioning opening. In addition, the positioning structure may be arranged only on the protective box 8, or only on the cabinet 1, or partly on the protective box 8 and partly on the cabinet 1. Those skilled in the art may flexibly set the specific structural form and specific arrangement position of the positioning structure in practical applications, as long as the protective box 8 can be positioned on the cabinet 1 through the positioning structure.

Preferably, as shown in FIGS. 1, 4 and 5, the positioning structure includes a first positioning portion 82 provided on the protective box 8 and a second positioning portion (not shown in the figure) provided on the cabinet 1. The protective box 8 and the cabinet 1 are positioned through the first positioning portion 82 and the second positioning portion. The first positioning portion 82 is a positioning column provided on the protective box 8, the second positioning portion is a positioning hole (not shown in the figure) provided on the cabinet 1, and the positioning column matches with the positioning hole. The positioning column is a circular column and the number thereof is four.

Correspondingly, the positioning hole is a circular hole and the number thereof is also four. The circular columns and the circular holes correspond to each other in a one-to-one correspondence. Of course, the positioning columns may also be configured as square columns, diamond-shaped columns, etc. Correspondingly, the positioning holes are configured as square holes or diamond-shaped holes. In addition, the number of the positioning columns and positioning holes may also be two, three, or five, etc. Such adjustments and changes to the specific structure, shape and specific number of the positioning columns and positioning holes do not depart from the principle and scope of the present disclosure, and should be defined within the scope of protection of the present disclosure. In addition, the first positioning portion 82 may also be a positioning hole provided on the protective box 8. Correspondingly, the second positioning portion is a positioning column provided on the cabinet 1, and the positioning column matches with the positioning hole. Such flexible adjustments should also be defined within the scope of protection of the present disclosure.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A clothing shaking device for a clothing care apparatus, the clothing care apparatus comprising a cabinet, and the clothing shaking device comprises: a driving member, a first connection member, a second connection member, a cross beam, and a connection structure provided on the cross beam; the driving member is fixedly connected to the cabinet, the cross beam is movably connected to the cabinet, the driving member is connected to a first end of the first connection member, and a second end of the first connection member is pivotally connected to a first end of the second connection member; a second end of the second connection member is provided with a wandering structure, and the wandering structure is drivingly connected to the connection structure; and wherein when the driving member drives the first connection member to rotate and thus drives the second connection member to move, the wandering structure can apply a force to the connection structure, which enables the connection structure and the cross beam to move back and forth together, and the wandering structure can weaken a movement transmitted to the cross beam via the second connection member in a direction perpendicular to the cross beam.

2. The clothing shaking device according to claim 1, wherein the wandering structure is a slip ring, and at least a part of the connection structure is accommodated in the slip ring; when the driving member drives the first connection member to rotate and thus drives the second connection member to move, the slip ring can apply a force to the connection structure, which enables the connection structure and the cross beam to move back and forth together, and the slip ring allows the connection structure to slide in the slip ring in the direction perpendicular to the cross beam.

3. The clothing shaking device according to claim 2, wherein a first spacing between inner side walls of the slip ring is larger than a maximum length of the connection structure, and a second spacing between the inner side walls of the slip ring is larger than or equal to the maximum length of the connection structure; and wherein the first spacing is a spacing of the inner side walls of the slip ring in the direction perpendicular to the cross beam, and the second spacing is a spacing of the inner side walls of the slip ring in a direction parallel with the cross beam.

4. The clothing shaking device according to claim 2, wherein the inner side walls of the slip ring jointly enclose an oblong-hole structure.

5. The clothing shaking device according to claim 2, wherein the inner side walls of the slip ring jointly enclose a rectangular-hole structure.

6. The clothing shaking device according to claim 2, wherein the connection structure comprises a swing rod and a connection column provided on the swing rod, the swing rod is connected to the cross beam, and the connection column is accommodated in the slip ring.

7. The clothing shaking device according to claim 6, wherein a first fixed structure and a second fixed structure are provided on the cross beam, and two ends of the swing rod are connected to the first fixed structure and the second fixed structure respectively.

8. The clothing shaking device according to claim 7, wherein the clothing shaking device further comprises a protective box which is fixedly connected to the cabinet; the first connection member, the second connection member, the swing rod and the connection column are all arranged in the protective box, the protective box is provided with a through hole on a side facing the cross beam, and both the first fixed structure and the second fixed structure pass through the through hole to be connected to the swing rod.

9. The clothing shaking device according to claim 8, wherein the through hole comprises a first through hole and a second through hole, the first fixed structure passes through the first through hole to be connected to one end of the swing rod, and the second fixed structure passes through the second through hole to be connected to the other end of the swing rod.

10. The clothing shaking device according to claim 1, wherein the driving member is a motor; and/or the first connection member is a first connecting rod, and the second connection member is a second connecting rod.

* * * * *